United States Patent [19]

Kopnicky

[11] Patent Number: 4,846,156

[45] Date of Patent: Jul. 11, 1989

[54] QUADRA-LIMBULAR THERAPEUTIC EXERCISE MACHINE

[76] Inventor: Robert J. Kopnicky, 425 Sturgeon Rd., Valparaiso, Ind. 46383

[21] Appl. No.: 597,462

[22] Filed: Apr. 6, 1984

[51] Int. Cl.[4] ..... A61H 1/02

[52] U.S. Cl. ..... 128/25 R; 272/134

[58] Field of Search ..... 128/25 R, 25 B, 33–36, 128/31, 39, 41, 44–46, 48, 49, 51, 52, 56, 57, 67; 188/32; 74/89.17, 89.18, 40, 51, 422; 366/111; 272/73, 134, 900; 5/60–65, 108, 109, 423, 449, 453, 433, 462, 464, 469; 269/28, 325, 60, 69; 297/337, 338, 345, 346, 423, 429, 374, 375, 377, 452

[56] References Cited

U.S. PATENT DOCUMENTS

| | | | |
|---|---|---|---|
| 75,218 | 3/1868 | Taylor | 128/25 B |
| 293,581 | 2/1884 | Kressly | 74/594.5 |
| 554,222 | 2/1896 | Hillhouse | 188/31 |
| 583,920 | 6/1897 | DeMontgomery | 128/25 R |
| 2,521,539 | 9/1950 | Richardson | 188/32 |
| 2,853,257 | 9/1958 | Cook | 188/32 |
| 3,074,716 | 1/1963 | Mitchel | 128/25 R |
| 3,174,768 | 3/1965 | Sanders | 188/31 |
| 3,216,722 | 11/1965 | Odom | 128/25 R |
| 3,727,608 | 4/1973 | Simsian | 272/73 |
| 3,905,457 | 9/1975 | Shea | 188/31 |
| 4,071,235 | 1/1978 | Zent | 272/73 |
| 4,186,920 | 2/1980 | Fiore | 128/25 B |
| 4,222,376 | 9/1980 | Proprotnik | 128/25 R |
| 4,273,113 | 6/1981 | Hofstein | 128/25 B |
| 4,402,502 | 9/1983 | Peters | 128/25 R |

FOREIGN PATENT DOCUMENTS

| | | | |
|---|---|---|---|
| 707456 | 4/1931 | France | 128/25 R |
| 580878 | 5/1958 | Italy | 188/32 |
| 851234 | 10/1960 | United Kingdom | 128/25 R |

*Primary Examiner*—Edgar S. Burr
*Assistant Examiner*—Aaron J. Lewis
*Attorney, Agent, or Firm*—Richard G. Kinney

[57] ABSTRACT

An exercise machine for use by a handicapped or impaired person from his wheelchair is disclosed which has a framework and wheelchair wheel-receiving ramps and cradle onto which the user may roll his chair. A set of rotatable hand cranks are interconnected by sprockets and a chain to a pair of orbitable pedal assemblies mounted on the frame. The pedal assemblies are provided with velcro-connection straps and weights so as to be self-orienting in an orientation that easily receives the user's feet, and means for releasably locking the pedal assemblies is provided. The latter is readily operable by the user so that he or she can rotate one of the pedal assemblies into an orbital position for easily inserting a foot, lock in that position, insert his foot, release the lock and using the hand cranks to move the other pedal assemblies into a convenient position, relock the mechanism and insert and fasten in place the other foot. The interconnected pedal-crank mechanism is mounted so that it can be easily pivoted on the framework so as to move from a convenient foot insertion position to a convenient exercise position; and user-operable means are provided for locking it in various pivotal positions. After exercise, the user may remove his feet from the machine by the same process of locking and rotating the pedal-hand crank and when this is done, move the wheelchair out of the cradle and ramps. The machine has the advantage that the user may enter, affix his feet, use, and remove his feet and exit without the need of assistance from anyone else.

1 Claim, 3 Drawing Sheets

QUADRA-LIMBULAR THERAPEUTIC EXERCISE MACHINE

BACKGROUND OF THE INVENTION

1. Field of the Invention

The present invention is directed to a new and improved therapeutic exercise machine, and particularly to such a machine for use by someone from a wheelchair.

2. Description of the Prior Art

Individuals who have suffered partial paralysis, e.g., spinal injury or stroke, have the need to exercise or range their unused or underused muscles and limbs. Failure to do so can result in atrophy of the muscles, easily broken bones, and if the body is not exercised, general deterioration of the cardiovascular system. Exercise tends to make joints more flexible, increases circulation, strengthens the heart, burns off calories, and often results in a general better feeling and psychological lift.

Thus, in addition to general exercise machines, e.g., as shown in U.S. Pat. Nos. 2,603,486; 3,216,722; 3,213,852; 4,222,376; 3,964,742; and 3,572,699; and French Patent No. 77,1466, publication no. 2,390,179 which are not adaptable to a partially paralyzed user or wheelchair user, there has been suggested special exercise or ranging machines such as those of U.S. Patent Nos. 3,730,174; 2,735,422; and 3,423,086.

Such devices are not, however, easily used by a person whose legs and feet are paralyzed and may, thus, easily fall off of conventional pedals, or else they are not convenient to use without an attendant to aid in attaching and releasing the user from the machine, and in the case of motor-driven machines, supervising the use to prevent possible accident.

SUMMARY OF THE INVENTION

A therapeutic exercise machine constructed in accordance with the present invention for use by a person having at least a partially paralyzed or weak limb comprises means for releasably captivating the extremity of the partially paralyzed or weak limb of the person and for orbiting that extremity, together with means operable by the other limbs of the person for driving the orbiting means to cause the limb extremity to be orbited to range or exercise the weak or paralyzed limb, and user operable means for releasably locking said orbiting means in a position wherein the means for releasably captivating the extremity is conveniently located for inserting or removing the extremity.

A second feature of the invention is a wheelchair receiving ramp and cradle which forms part of the base of the machine and allows a substantial part of the weight of the wheelchair and user to serve to help hold the machine in place during use.

The invention, together with the advantages thereof, may best be understood by reference to the following description taken in connection with the accompanying drawings, in the several figures of which, like reference numerals identify like elements.

DESCRIPTION OF THE PREFERRED EMBODIMENT

Figure 1:
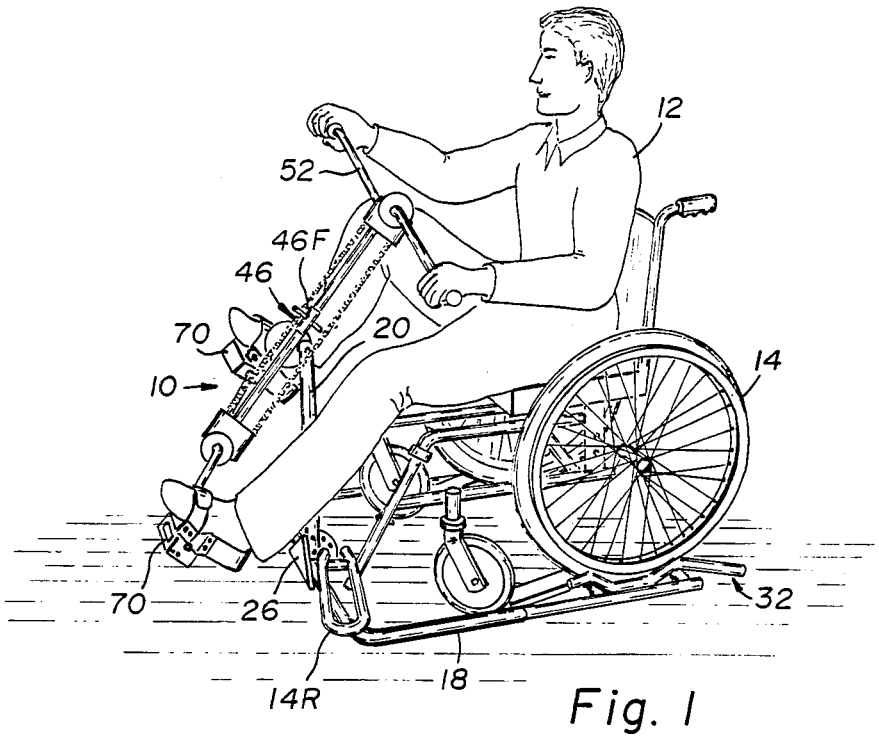
FIG. 1 is a perspective view of a therapeutic exercise machine constructed in accordance with the present invention, in use by a wheelchair-bound, partially paralyzed person.

Referring now to FIG. 1, there is depicted a therapeutic exercise machine constructed in accordance with the present invention and generally designated by the number 10. The machine 10 is illustrated in use by a man 12 who is seated in a wheelchair 14 of more or less common construction. FIG. 1 illustrates the manner of use by a person 12 who may have paralyzed legs and feet.

Figure 2:
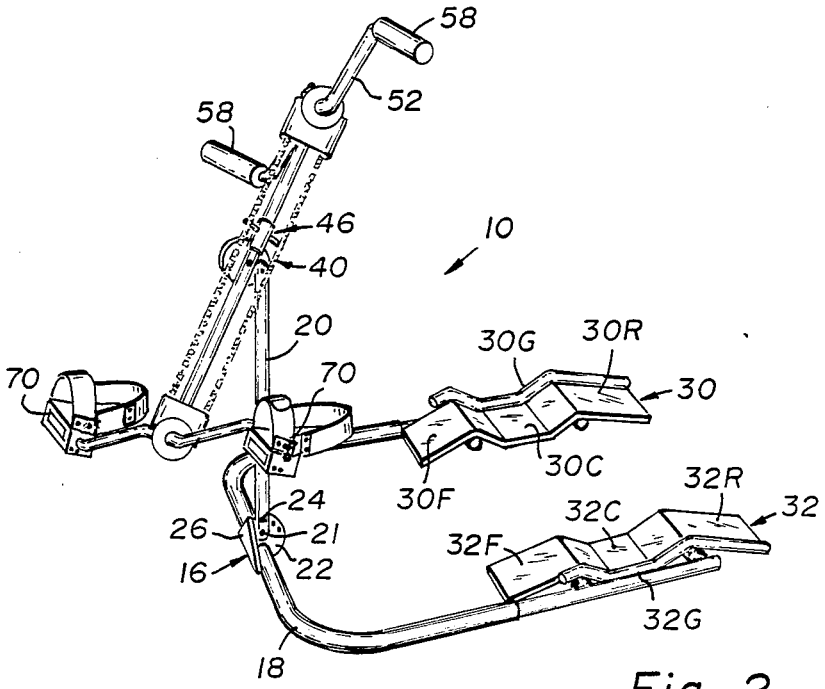
FIG. 2 is a perspective view of the therapeutic exercise machine of FIG. 1.

As better shown in FIGS. 1 and 2, the machine 10 includes a frame 16 comprising a general U-shaped base 18 and a standard 20 rising from the center of the base 18. The base 18 and standard 20 may conventionally be tubular steel and are preferably affixed together in such a manner as to allow the standard 20 to be secured in several pivotal displacements, including flat for storage and shipping. One such construction is illustrated wherein standard 20 is formed with a cutout defining two legs that extend on either side of a semi-circular plate 22, and is pivotally attached thereto at 21. The plate 22 has a number of holes as does the standard 20 through which a pin 24 may pass to secure the standard 20 at 90°, and, e.g., 70° and flat in relationship to the base 18. To provide added rigidity, a triangle gusset plate 26 is welded to the base 18 and the front of disc 22.

In accordance with one feature of the invention, the base 18 is provided with wheel ramp and cradle assemblies 30, 32 which are mirror images of each other and provide a cradle 30C, 32C into which the large wheels of the chair 14 fit. The cradle 30C and cradle 32C has forward ramps 30F, 32F and reversal ramps 30R, 32R. The forward ramps 30F, 32F easily allow the front wheels of the wheelchair 14 to advance over and back from the cradle while the reversal ramps 30R, 32R allow both sets of wheels to easily travel to and from the cradle 30C, 32C.

That is, in entering the machine 10, the user 12 maneuvers his wheelchair 14 to advance (from the left in FIG. 1) with the wheels aligned with the ramps 30R, 32R and propels the front wheels up the ramp into the cradle 32C and then up/out of the cradle and down the ramps 30F, 32F. As the front wheels leave the cradle, the rear wheels of the chair 14 ride up the ramps 30R, 32R and as the wheelchair 14 advances further down into the cradles 32C and 30C to the position shown in FIG. 1.

Figure 4:
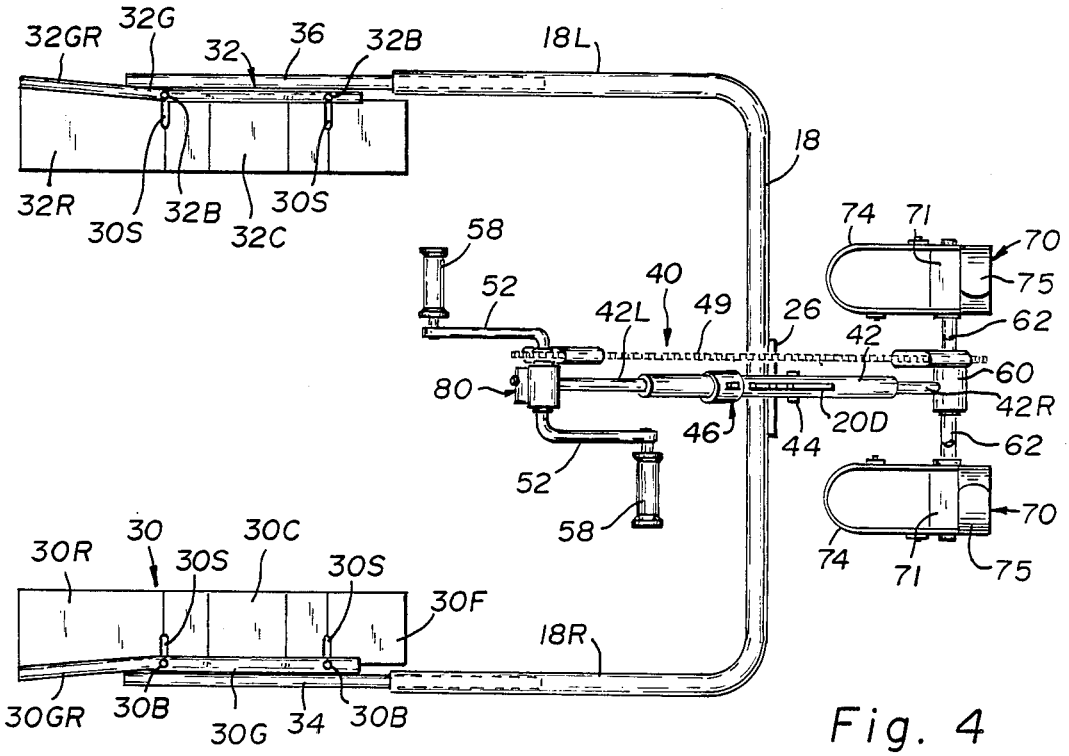
FIG. 4 is a plan view of the machine of FIGS. 1 through 4 with some interior parts shown in dashed outline.

Guide bars or tubes 30G and 32G are provided at the outside of the cradle and ramp assembly, and as shown in FIG. 4, are forced outward at their rearward ends 30GR and 32GR so as to aid in aligning the wheels of the wheelchair 14 as it enters the assemblies 30, 32.

The assemblies 30, 32 are preferably constructed so as to have the distance between them adjustable upon initial setup to accommodate the wheel width of the user's particular chair 14, and center the forward part of the chair at the standard 20.

The guides 30G, 32G are preferably adjustable to accommodate a range of wheelchair widths. This is achieved by affixing them by means of bolts 30B, 32B through the slots 30S, 32S.

Figure 3:
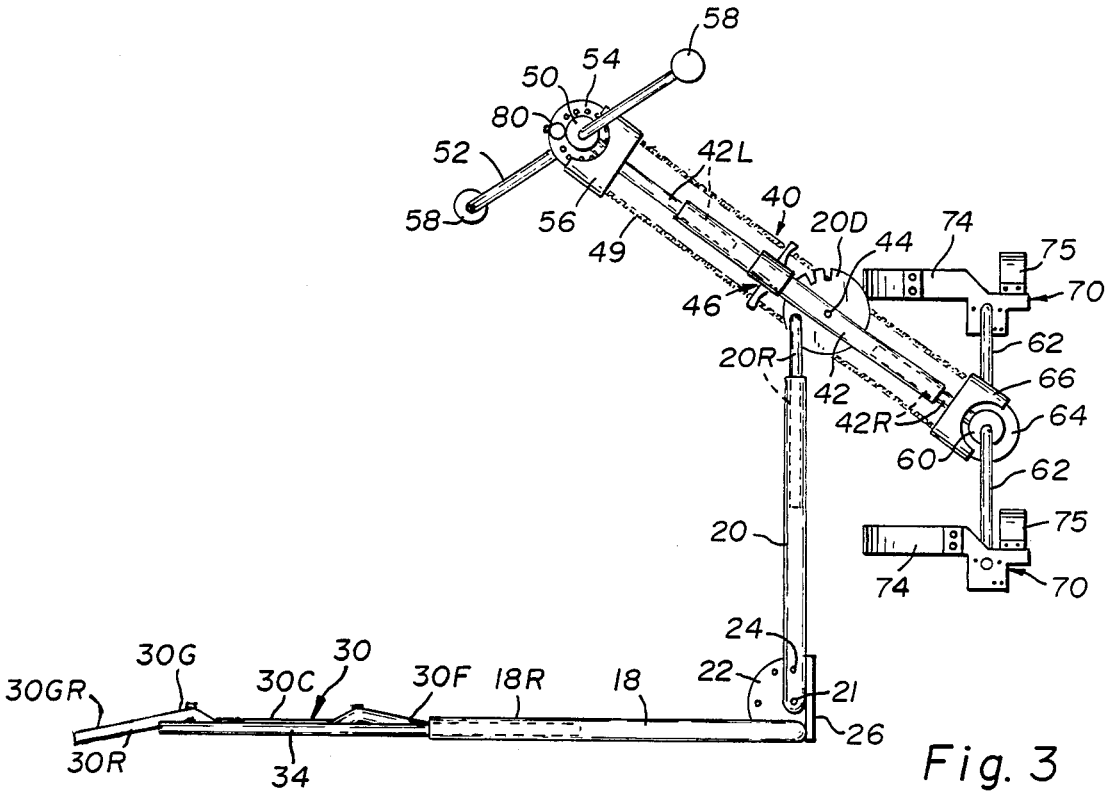
FIG. 3 is a side view of the machine of FIGS. 1 and 2 with interior parts shown in dashed outline.

In any case, the assemblies 30, 32 are each affixed to a portion of the U-shaped base 18, namely, rods 34, 36 which are each received in tubular sections 18R, 18L of the base 18 as shown in FIGS. 3 and 4. The rods 34 and 36 are affixed by means of set screws (not shown) at setup and, as desired thereafter, adjusted in position in and out from the standard 20 so as to accommodate the particular wheelchair 14.

It should be noted that the weight of the wheelchair 14 and user 12 are substantially placed in the cradles 30C and 32C so as to hold the machine 10 in place during use and that the cradles 30C and 32C serve to hold the wheelchair on the base without the need for chains or mechanical connections as used in the prior art.

A prototype has been built and extensively tested by a vigorous, young man who was paralyzed from the chest down and showed no tendency to upset, move about, or for the wheelchair to leave the cradles, even during vigorous exercise sessions.

As also shown in FIG. 3, the standard 20 is preferably also made to be extended with a rod 20R extending into the tubular metal of the lower portion of the standard 20 and preferably affixed by means of set screws at initial set up, again, to allow adjustment to accommodate the user's size. At the top of the rod 20R is welded a pivot disc 20D to which is pivotally attached a chain drive assembly 40. The assembly 40 includes a central longitudinal member 42 preferably of tubular steel stock slotted to fit over the disc 20D and be pivotally attached by a bolt 44.

Figure 5:
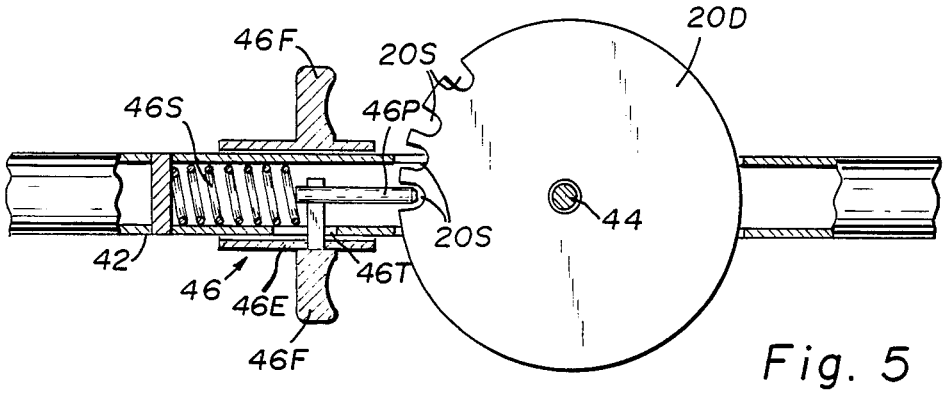
FIG. 5 is a detailed sectional view of a portion of the machine of FIGS. 1 through 4.

As better shown in FIG. 5, the disc 20D has several rim edge lock slots 20S and the member 42 is equipped with a manually operable locking assembly 46 comprising a locking plate 46P mounted internally of member 42 and urged by a spring 46S into engagement into one of the slots 20S. The plate 46P is connected to a sleeve 46E that fits loosely about the member 42 through a slot 46T. The sleeve 46E has finger grips 46F secured to it.

Note that the locking assembly 46 and the finger grips 46F are positioned within easy reach of the user 12 when he is positioned as shown in FIG. 1 so that he may draw back the finger grips 46F and, thus, the sleeve 46E and lock plate 46P against the spring bias provided by spring 46S and pivot the assembly 40 on disc 20D to another one of its slots 20S and lock it in that pivotal position by releasing the finger grips 46F.

While we have depicted the disc 20D with four operable locking slots 20S, it can, of course, be constructed larger and with more such slots to give the user more options for the locked pivotal position of the assembly 40.

The assembly 40 is preferably longitudinally adjustable (on setup) as shown in FIGS. 3 and 4 by the means of rods 42R and 42L that are received in a close fit into the right and left ends (as seen in FIG. 3) of the member 42 and secured, again, by set screws (not shown).

At the ends of the member 42, the ends of rods 42L and 42R are welded to bicycle-type hubs 50 and 60 which contain, respectively, double hand cranks 52 and double foot cranks 62. Each of these double cranks 52 and 62 have their two cranks offset by 180° from each other and have affixed to them sprockets 54 and 64 and an endless chain 49 is operably engaged about both sprockets 54 and 64 such that rotation of one crank 52 or 62 rotates the other.

Chain guards 56 and 66, as best shown in FIG. 3, are preferably mounted in a conventional manner to aid in the prevention of any accidental entanglement during use.

At the ends of the cranks 52 are provided freely rotatable hand grips 58, while in accordance with another feature of the invention, novel foot pedal assemblies 70 are provided.

Figure 6:
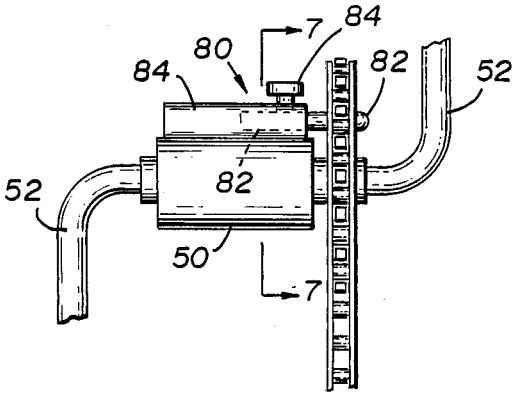
FIG. 6 is a detailed elevational view of another portion of the machine of FIGS. 1 through 4 with an interior part shown in dashed outline.
Figure 7:
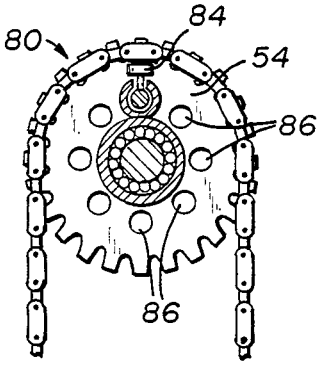
FIG. 7 is a partly sectional, elevational view of a portion of the machine of FIGS. 1 through 6 as seen when looking in the direction of the arrows from the plane defined by the line 7—7 in FIG. 6.

In accordance with one important feature of the invention, means 80 for locking at least the foot pedal assemblies 70 against rotation are provided, and as shown best in FIGS. 6 and 7, comprises a sliding bolt 82 provided in a sleeve 84 welded or otherwise secured to the hub 50. The bolt is affixed to a manual slider 84 for easy operation by the user 12 when he is positioned as shown in FIG. 1. The locking assembly 80 further includes bores or holes 86 spaced at equal distances about the sprocket 54 and sized to closely receive the bolt 82 when it is moved to the right as shown in FIG. 6.

This lock 80 serves to allow the user 12 to easily insert his paralyzed legs and feet into the pedals one at a time without the aid of another person. This is done by the user 12, after positioning the wheelchair as shown in FIG. 1, pivoting the pedal end of the unit 40 downward and close to him (by operating lock 46). He then rotates the hand cranks to move, for example, the right pedal assembly 70 into a position just in front of and above his right foot. He then operates lock 80 to secure that pedal assembly 70 in place and then proceeds to place and secure his foot in a manner as will be explained below.

He may then release the lock 80 and, rotating the hand crank, repeat the process to install his left foot into the left pedal assembly 70.

Figure 8:
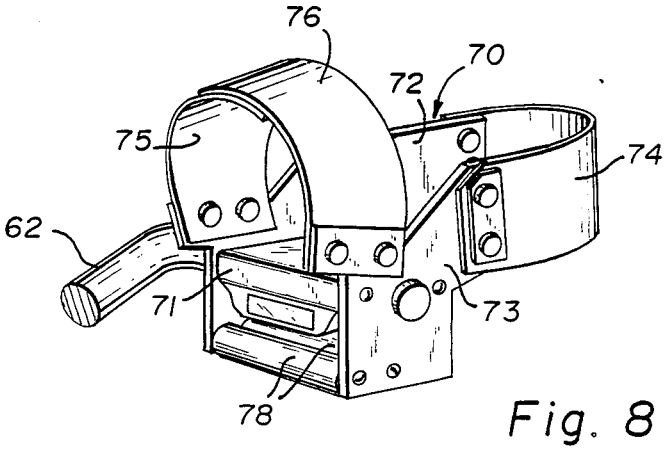
FIG. 8 is a perspective detailed view of another portion of the machine of FIGS. 1 through 7, namely, the left foot pedal.

The novel pedal assembly 70 is best shown in FIG. 8 and as both assemblies 70 are identical (but mirror images of each other), only one need be explained here in detail, it being understood that the other is constructed in the same manner. The pedal assembly 70 is preferably constructed about a conventional bicycle pedal 71 and includes a pair of side plates: an inside plate 72 and an outside plate 73. A flexible heel strap 74 is fastened between the rearward ends of these plates and serves to accept the heel of the shoe of user 12. Attached to the upper portion of each side plate 72, 73 are straps 75, 76 which are readily affixable together by a hook-and-loop or velcro-type fastener so as to form a stirrup over the forward part of the user's foot (see FIG. 1).

The inside plate 72 is made long enough to span rearward along the foot to the area of the user's heel, and both plates 72 and 73 are high enough to protect and hold the foot between them. This construction protects the foot from inadvertently pivoting inward or outward and is especially important for a paralyzed foot, in which case lacks not only control but also feeling.

As mentioned above, a major advantage of the present invention is the ability of a user, even though having paralyzed legs and feet, to engage himself into the machine from his wheelchair without the need of assistance. One feature of the pedal assemblies 70 that aids in this is the provision of weights 78 secured below the pedal 71 that tend to align, and if distributed, to return the pedal assembly to the orientation shown in FIG. 8; that is, with the stirrup straps 75, 76 upward facing. This allows the user to use his hands to lift his leg and not need to keep a hand on the pedal assembly.

In use, the machine 10 would normally be more or less permanently set up to receive a particular sized wheelchair of its owner. The assembly 40 would be pivoted to a nearly vertical position and there locked by means 46 approximately as shown in FIG. 2. The user would maneuver his wheelchair so as to have a straight run up the ramps 30R, 32R between the guides 30G, 32G. He would then propel the wheelchair 14 so that the front wheels travel up and over the ramps 30R, 32R and through the cradles 30C, 32C and down the front ramp 30F, 32F as the main wheels run up the rear ramp 30R, 32R and into the cradles 30C, 32C. The cradles 30C, 32C are sized to receive tightly the large wheels of the chair 14. The user then could lock the main wheels of his wheelchair and move his feet off of and over the foot rests (e.g., the rests 14R shown moved aside in FIG. 1). He then would, if necessary, rotate the hand cranks 52 to move one of the pedal assemblies into a position wherein it may easily receive his foot and then use the lock mechanism 80 to lock it in that position.

The straps should be secured together to form a large loop (75 and 76). The user then lifts his leg with his hands and arms and places the foot into the pedal assembly 70 with the heel set back against strap 74. Checking to see that the foot is properly aligned, he then grasps the straps 75, 76 and tightly fastens them together (FIG. 1).

The lock 80 may then be released and the hand crank turned 180° to bring the opposite pedal assembly 70 into position and lock mechanism 80 activated to again lock up the pedal positions. The process of placing that foot in and fastening it in is then accomplished. At this point, the user may choose to raise and extend his legs by activating the lock mechanism 46 and pivoting down the hand cranks 52 to, e.g., the position shown in FIGS. 1 and 3 and relocking it in that position. He may then release the locking means 80 and by rotating the cranks 52, drive the cranks 62 through the sprockets 54, 64 and chain 49, thus, ranging and exercising his leg and lower torso and back muscles, and move his knee, ankle, and hip joints.

At the conclusion, e.g., after a period of twenty minutes of vigorous exercise, the user may reverse the process to disengage himself from the machine 10. That is, to pull up on the lock mechanism 46, and pivot up assembly 40 to a nearly vertical position, and relock 46 and, having lowered the feet rests 14R of his wheelchair 14, then using the lock 80 to disengage his feet from one, and then the other, pedal assembly 70, returning then to the lowered rests 14R, and unlocking his wheelchair wheels, back it out of the cradle ramp assemblies 30, 32.

Note should be made that this entire operation, which explained in some length, can be rapidly learned and done by the user (often in less time than it takes to read about it here) and, most importantly, can be done entirely by himself or herself. Outweighed by the mere economic advantage of saving on labor of a nurse or other attendant is the psychological lift given to a partially paralyzed person in being able to accomplish this for himself or herself. This is one of the intangible but significant advantages of this invention.

As mentioned above, a prototype of the invention has been made and tested. This prototype generally corresponds with the depicted and disclosed machine 10. For purposes of illustration and completeness of this disclosure and not for limitation of the invention, this particular prototype was constructed of 1 inch steel pipe for standard 20 and base 18 with rods 34, 36 and 20R being of $\frac{3}{4}$ inch steel pipe. The arms of the U-shaped base 18 are 28 $\frac{1}{2}$ inches apart, on center, with a length of 20 $\frac{1}{4}$ inches for the arms that receive rods 34, 36. The ramp and cradle assembly is formed of 12 gauge steel, 6 inches wide, and is about 22 inches in length overall. The guide bars are constructed of $\frac{3}{4}$ inch steel pipe bent as shown. Standard bicycle cranks and wheels were used for the hubs 50 and 60 and cranks 52 and 62. The handles 58 are modified bicycle pedals. Member 42 is made of 1 inch steel pipe and is 16 $\frac{1}{2}$ inches overall. The disc 20D is a $\frac{3}{8}$ inch thick plate 4 $\frac{1}{4}$ inch in diameter, although as mentioned above, it could be made larger to allow for more locked pivotal displacement positions for assembly 40.

As should now be apparent, however, the features of the present invention can be adapted to many forms and modifications and, indeed, although the presently contemplated best mode of practicing the invention has been disclosed and depicted, the inventor himself may, based upon experiments and to achieve economics of manufacture, make changes therefrom in future commercial embodiments.

As an example of changes that may be readily incorporated, the mechanism readily adapts itself to incorporation of a mechanical braking such as the clamp shown by Nies' U.S. Pat. No. 3,572,699 in which case it would be on one or the other sprockets, or of the type shown by Odom U.S. Pat. No. 3,216,722.

Also, the spacing between the guides 30G and 32G could be made more easily adjustable, for instance, by a screw drive mechanism so that the same machine could be more easily used by people with different sized wheelchairs.

While described in an embodiment for use by one who has his legs partially or fully paralyzed, the machine can easily be adjusted for use by those who have other afflictions, such as stroke victims who often have partial paralysis on the left or right side. In this case, a handle assembly for folding the user's disabled hand into the handle 58 would be employed and, of course, he would drive the linked cranks with his good limb to range or exercise his paralyzed or weak limb.

Further, while the specific locking mechanism 80 is preferred for its simplicity of construction and ease of use, other mechanisms can, of course, be employed, including one that could employ the spacings between sprocket teeth, e.g., on the bottom of the sprocket, to receive the locking bolt and, thus, eliminate the need for forming the holes or bores 86.

While shown with two sprockets, three or more could be employed to accommodate counters for revolutions, and to help in adjusting the length of the unit 40 without changing the length of the chain 49 and to more easily accommodate a friction brake. Such sprockets can be made larger and of different sizes, as can the lengths of the cranks and the ratio of their lengths to aid in aerobic exercise. Likewise, conventional monitors (and alarms) for heart rate and blood pressure, as well as timers and "distance" counters can be incorporated into or added to the machine to aid the user in judging the quality and quantity of the exercise performed on the machine.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

What is claimed is:

1. A therapeutic exercise machine for use by a handicapped person, when such person is positioned in an exercising position at the machine, comprising, in combination, a frame;

hand cranks mounted on the frame;

foot pedals mounted on the frame;

means incorporated on at least one of said foot pedals for releasably captivating a foot of the person, said captivating means being manually operable by the person to captivate or release that foot, said means being operable by the person when in the exercise position at the machine;

means interconnecting said hand cranks and said pedals for allowing said pedals to be rotated in tandem with said hand cranks, such that rotation of one rotates the other;

a releasable locking means mounted on said frame and positioned to be manually operated by the person from the exercising position at the machine, for locking at least said foot pedal against rotation, whereby the user may, from the exercising position at the machine, manually position the one pedal by rotating the hand cranks, lock it in position, place and manually captivate his one foot therein using said captivity means, release the lock, range or exercise his limbs including the captivated foot, re-lock the pedals and manually release and remove that foot from the one pedal, all unaided by anyone else, and wherein said foot pedals are mounted to the frame by means whereby they may be moved toward or away from the user by said user, such means including manually operable means positioned on said frame for easy use by the user from the exercising position for unlocking and re-locking the pedals in any one of a number of moved positions, and wherein the machine is for use by a person in a wheelchair of the type that has large wheels, and said frame includes a base having a ramp and cradle assembly, comprising:

cradle means for receiving in a close fit the large wheels;

ramp means leading to and from the cradle means; and guide bars above the ramp means for guiding the wheels onto the ramp means and into the cradle, whereby the user may propel his large wheelchair wheels up the ramp means and into the cradle means and thereby add a substantial portion of the weight of the person and wheelchair to the machine base, and the person's position in the wheelchair so received in the cradle serves as the exercising position from which the person may, unaided use the machine.

* * * * *